United States Patent [19]

Eichweber

[11] Patent Number: 4,793,811

[45] Date of Patent: Dec. 27, 1988

[54] ARRANGEMENT FOR SHOT SIMULATION

[75] Inventor: Kurt Eichweber, Hamburg, Fed. Rep. of Germany

[73] Assignee: Precitronic Gesellschaft fuer Fein-Mechanik und Electronic mbH, Hamburg, Fed. Rep. of Germany

[21] Appl. No.: 62,009

[22] Filed: Jun. 12, 1987

[30] Foreign Application Priority Data

Dec. 17, 1986 [DE] Fed. Rep. of Germany ..... 3643107

[51] Int. Cl.[4] ..... G09B 9/00

[52] U.S. Cl. ..... 434/22; 434/19

[58] Field of Search ..... 434/19–22

[56] References Cited

U.S. PATENT DOCUMENTS 3,802,098 4/1974 Sampson et al. ..... 434/20
4,340,370 7/1982 Marshall et al. ..... 434/22
4,671,771 6/1987 LaRussa et al. ..... 434/22
4,680,012 7/1987 Morley et al. ..... 434/22

*Primary Examiner*—Leo P. Picard
*Attorney, Agent, or Firm*—Townsend & Townsend

[57] ABSTRACT

The arrangement for shot simulation with a shot simulator and at least one target is characterized in that the target has a device for emitting light of a wavelength outside the visible wavelength range and the shot simulator has a receiving device for the light. The shot simulator also possesses a device for measuring the period of time between the detection of the target as a result of the emitted light and the firing of a simulated shot. By means of this arrangement, the reaction time required by the gunner between the detection of the target, the identification of the latter and the firing of a shot and a hit can be measured effectively.

18 Claims, 2 Drawing Sheets

ARRANGEMENT FOR SHOT SIMULATION

Figure 1:
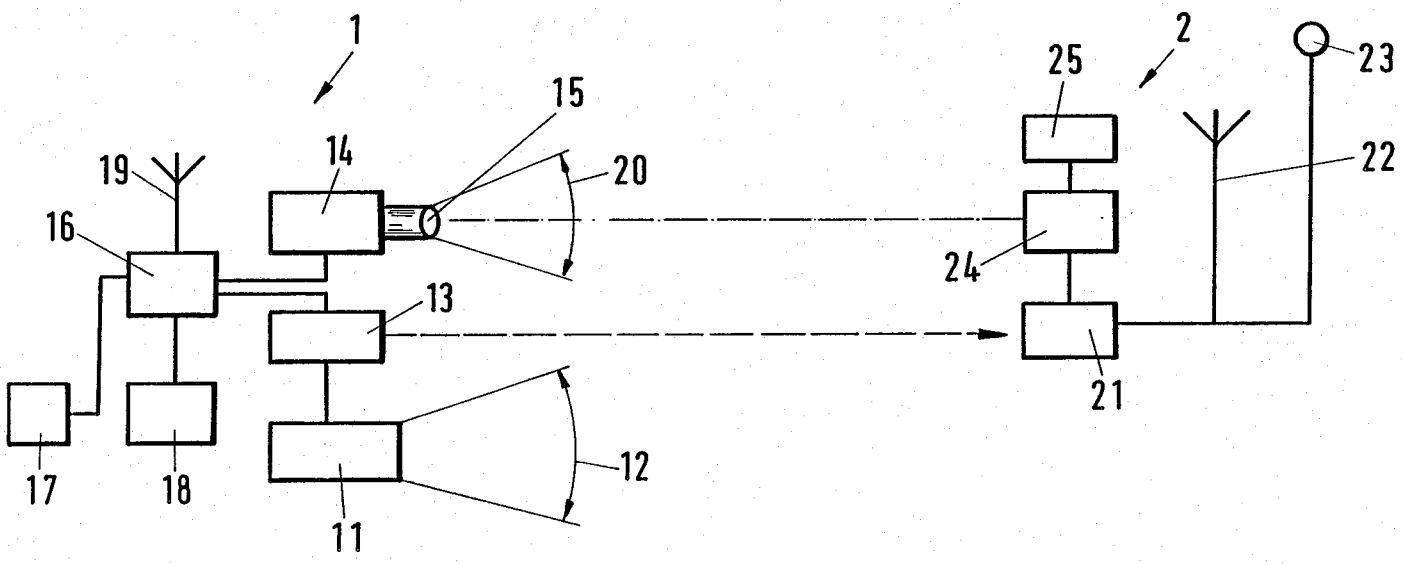

The invention relates to an arrangement for shot simulation with a shot simulator and at least one target.

Shot simulators are very often used for combat training. They display hit results, so that the gunner and, if appropriate, also the instructor can ascertain whether a shot actually fired would have scored a hit.

However, one disadvantage of these known shot simulators is that, in the known units, although the fact of a hit is displayed, there is normally no information provided as to how quickly the gunner detected, identified and actually hit the target. But it is precisely this reaction time which should be known accurately, in order to obtain a reasonable picture of the level of training of the gunners. It is then possible, in this way, to check how quickly the gunner reacts to the appearance of a target and identifies it as a friendly target or an enemy target, and how quickly he then aims the shot simulator at this target and fires his shot.

The object of the invention is, therefore, to provide an additional arrangement for a shot simulator, be means of which the time between the appearance of a target and the firing of a shot can be measured.

In the solution according to the invention, the target has a device for emitting light of a wave-length outside the visible wavelength range and the shot simulator has a receiving device for the light, and the shot simulator possesses a device for measuring the period of time between the detection of the target as a result of the emitted light and the firing of a simulated shot.

The target is therefore equipped with an additional light source which is not needed for the actual operation of the shot simulator. This light source also emits light of a wavelength outside the visible wavelength range. Consequently, the realistic nature of the training is not adversely affected by this additional arrangement by the target still emitting visible light signals.

The appearance of light from the target can nevertheless be detected by appropriate receiving devices on the shot simulator. The period of time between the detection of the target and the firing of a simulated shot is then subsequently measured, so tha the gunner's reaction time can be measured.

Infrared light is appropriately used as invisible light, although other invisible light, for example ultraviolet light, could also be used.

Appropriately, the timing device is designed for measuring the period of time between the detection of the target and a simulated shot by which a hit is achieved. This can prevent the gunner from firing a less carefully calculated shot relatively quickly after detecting a target, in order to achieve good reaction times, or, for example, prevent him from making do without changing to a suitable type of ammunition.

Advantageously, the device for emitting light is a flashlight source. At the same time, the flashlight pulses can carry an identification, for example at least two different identifications for friendly and enemy targets. But in addition, the identification can also contain information on the weapon type of the target, so that it is also possible to check directly and automatically whether the gunner has selected the correct ammunition, for example armor-piercing ammunition, for shooting at the target.

At the same time, the flashlight pulses can be coded by means of pulse-frequency, pulse-width and/or pulse-interval modulation.

Although the receiving device could be a device receiving light from all directions, it expediently has an imaging system, so that it is more sensitive to light from the relevant directions. Thus, the receiving device could have an objective and a photodiode or else, for example, an objective and a video camera, especially a CCD camera. The advantage of this, in comparison with a simple photodiode, would be that additional information on the location of the target could be obtained and used further for evaluation or shot simulation.

Advantageously, at the same time, the image angle of the objective of the receiving device corresponds at least to the image angle of the weapon aiming system. In this case, the target is detected and signalled as having appeared, as soon as the gunner has noticed it on looking through the sight of the weapon aiming system. If the gunner is expected not only to look through the sight of the weapon aiming system, but also notice targets lying outside this field of vision, a larger image angle would be selected for the objective of the receiving device.

If the target is equipped with a device for emitting visible light after a hit has been achieved, a very clear indication, visible to anyone, that a specific target has been hit is obtained. This corresponds to a real situation with actual shooting, in that it can be seen from a target that it has been hit. For example, in combat training, this prevents other gunners from still firing at the target already hit.

The device for emitting invisible light and visible light could have a single flashlamp and filters arranged in front of the latter, the advantage of this being that only a single flashlamp is required. The filters could be, for example, two concentric transparent cylinders surrounding the flashlamp and equipped alternately with sectors which are permeable only to infrared light on the one hand or to infrared light and yellow light on the other hand. If, at the same time, the sectors for infrared light on the one hand and those for infrared light and yellow light on the other hand are located opposite one another, only infrared light is transmitted. If one of the cylinders is then rotated relative to the other, so that identical sectors are opposite one another, in addition to infrared light which is now no longer of particular interest, yellow light is also emitted, so that it is possible to ascertain that the target has been hit.

Expediently, the arrangement has an instant display of the results, so that the gunner and also an instructor can read off the reaction time at any moment. Expediently, however, the arrangement also has a memory for recording the results, so that the results can also be read off subsequently and, for example, discussed.

By means of the arrangement according to the invention, it is thus possible to determine the gunner's reaction time realistically. It is possible, without much difficulty, to read off the time within which the gunner, after detecting the target, actually begins to fight it effectively.

Figure 2:
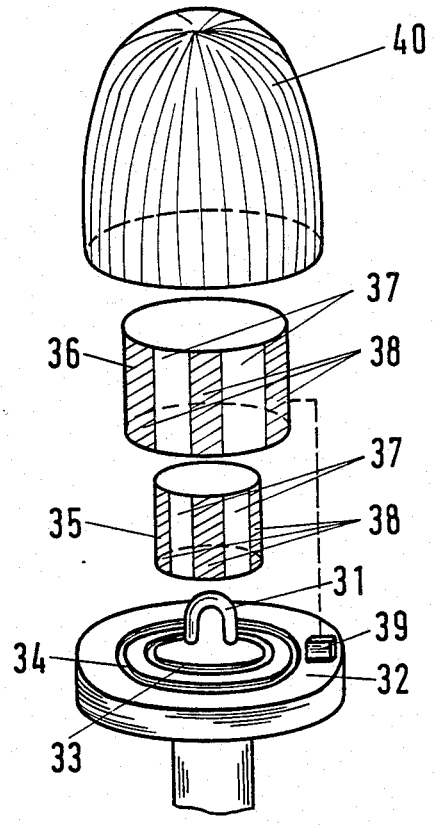

The invention is described below by way of example by means of advantageous embodiments, with reference to the accompanying drawings in which:

FIG. 1 shows a diagrammatic representation of the principle of the invention, and FIG. 2 shows a special embodiment of part of the arrangement according to the invention in an exploded perspective view.

FIG. 1 shows a shot simulator 1 and a target 2. The shot simulator 1 has a weapon aiming system 11 with a sighting field 12. An arrangement 13 for firing a simulated shot, for example a laser beam, is also provided. By means of a matrix CCD camera 14 with an objective 15 having a field of view 20 at least as large as the sighting field 12, invisible light, for example infrared light, emitted by the target 2 can be detected. Both the laser transmitter 13 and the light detector 14 are connected to a measuring and evaluating circuit 16 which is also connected to a memory 17 and a display 18.

Finally, an antenna 19 is also connected to the measuring and evaluating circuit 16.

The target 2 has a detector 21, by means of which the simulated shot fired can be detected in the form of a laser pulse. When this laser pulse and therefore a hit is recorded, a corresponding signal is emitted via the antenna 22, is detected by the antenna 19 of the shot simulator 1 and can be recorded there as a hit in the circuit 16. At the same time, a visible light signal is generated via a light source 23, to make it thus possible in a realistic way for the gunner to observe a hit directly in a similar way to a real situation.

The target 2 also has a source 24 of infrared light, and to identify the target this infrared light source can be equipped with an appropriate modulation device 25, so that the invisible light signals of each target 2 carry the identification of the target.

As soon as the infrared light from a source 24 is detected by the matrix CCD camera 14, the time which elapses before a simulated shot 13 is fired, is measured in the unit 16. The corresponding results can be stored in a memory 17 and indicated in a display 18. If desired here, such an event can be recorded by signaling a hit via the antennae 22 and 19, only when a hit has actually been achieved and not just when a shot has been fired.

In the embodiment of FIG. 1, a visible light source 23 and an additional light source 24 for the invisible light are required. These two can be combined according to FIG. 2. Here, the light source is a flashlamp 31 which is arranged on a baseplate 32. The baseplate has annular depressions 33, 34 or other fastening means for a small cylinder 35 and a larger cylinder 36 which are arranged above the flashlamp 31, in such a way that they cover the latter completely. The cylinders 35 and 36 have strip-shaped regions 37 which are permeable to infrared light and yellow light. The cylinders 35 and 36 also have regions 38 which are permeable only to infrared light, but not to yellow light. The inner, smaller cylinder 35 is fixed in place above the flashtube 31, whereas the outer cylinder 36, which covers the inner cylinder 35, can be rotated about its cylinder axis by means of a drive 39.

As long as the target is not actually hit, the outer cylinder 35 is rotated so that its strip-shaped regions 38 peremable only to infrared light are arranged above the strip-shaped regions 37 of the inner cylinder 35 which transmit infrared light and yellow light. Since the regions 38 have at least the width of the regions 37, only infrared light is transmitted in this position.

When the target is hit, the outer cylinder 36 is rotated by means of the drive 39 to the position, in which (see FIG. 2) the regions 37, on the one hand, and the regions 38, on the other hand, of the two cylinders 35 and 36 are arranged above one another. In this position, not only infrared light, but also yellow light can escape outwards from the flashlamp 31; it is also possible to ascertain visually that the target has been hit.

In this embodiment, therefore, one light source is sufficient. At the same time, it goes without saying that the protective dome 40 must be transparent both to infrared light and to yellow light. Instead of the embodiment illustrated, it would also be possible to make do with a flashlamp 31 if, for example, the protective cover 40 were colored yellow and there were a single cylinder permeable only to infrared light, normally covering the flashlamp 31 and lifted off from this when visible light is to be emitted.

I claim:

1. An apparatus for the in-field simulation of actual combat, comprising:

a full-sized target, capable of unrestricted, random movement on a combat field, including means for emitting invisible light comprising radiation of a non-visible wavelength, and hit detecting means for detecting a light beam directed at the target;

a shot simulator spaced from and independent of the target, including means for firing a first beam of light at the target and receiving means for detecting the invisible light emitted by the target;

whereby the detection of the invisible light by the receiving means provides an indication when the target comes in the field of view of the shot simulator, and the detection of light by the hit detecting means provides an indication when the target was hit by the first light beam; and means for measuring the period of time between the detection of the invisible light by the receiving means and the firing of said first beam of light by said shot simulator, to thereby determine the reaction time between the time the target comes in the field of view of the shot simulator and the time the first beam is fired at the target.

2. The apparatus of claim 1, wherein said means for firing includes an infrared light.

3. The apparatus of claim 1, wherein said means for measuring is adapted to measure the time between the detection of the invisible light emitted by said target and a hit of said target with said first beam of light.

4. The apparatus of claim 1, wherein said means for emitting invisible light includes a flashlight.

5. The apparatus of claim 1, wherein said means for emitting invisible light includes means for identifying said target.

6. The apparatus of claim 1, wherein said means for emitting invisible light includes pulse-frequency modulation coding for identifying said target.

7. The apparatus of claim 1, wherein said means for emitting invisible light includes pulse-width modulation coding for identifying said target.

8. The apparatus of claim 1, wherein said means for emitting invisible light includes pulse interval modulation coding for identifying said target.

9. The apparatus of claim 1, wherein said hit detecting means includes an imaging system.

10. The apparatus of claim 9, wherein said hit detecting means includes an objective having an image angle and a photodiode.

11. The apparatus of claim 10, wherein said shot simulator includes means for aiming having a first image angle, and said objective has a second image angle at least as great as said first image angle.

12. The apparatus of claim 9, wherein said hit detecting means includes an objective and a video camera.

13. The apparatus of claim 12, wherein said video camera is a CCD camera.

14. The apparatus of claim 1, wherein said target includes means for emitting visible light for indicating that said target has been hit.

15. The apparatus of claim 1, wherein said means for emitting invisible light includes a flashlamp and filter means for passing non-visible wavelengths of light from said flashlamp and for selectively passing visible wavelengths when said target is hit.

16. The apparatus of claim 1, further including means for instantly displaying data from said means for measuring.

17. The apparatus of claim 1, further including means for recording data from said means for measuring.

18. The apparatus of claim 1, further including a high frequency transmission device for relaying data from said means for measuring, and including a central receiving unit for receiving and analyzing data from said transmission device.

* * * * *